US005916011A

United States Patent [19]

Kim et al.

[11] Patent Number: 5,916,011

[45] Date of Patent: Jun. 29, 1999

[54] PROCESS FOR POLISHING A SEMICONDUCTOR DEVICE SUBSTRATE

[75] Inventors: Sung C. Kim, Pflugerville; Rajeev Bajaj; Mark A. Zaleski, both of Austin, all of Tex.

[73] Assignee: Motorola, Inc., Schaumburg, Ill.

[21] Appl. No.: 08/780,113

[22] Filed: Dec. 26, 1996

[51] Int. Cl.[6] ..... B24B 7/24

[52] U.S. Cl. ..... 451/41; 451/60; 451/443; 451/446; 451/57; 451/287

[58] Field of Search ..... 457/41, 57, 285–289, 457/443, 60, 446, 527

[56] References Cited

U.S. PATENT DOCUMENTS

| | | | |
|---|---|---|---|
| 4,841,680 | 6/1989 | Hoffstein et al. | 451/533 |
| 4,927,432 | 5/1990 | Budinger et al. | 51/298 |
| 5,064,683 | 11/1991 | Poon et al. | 451/28 |
| 5,081,051 | 1/1992 | Mattingly et al. | 437/10 |
| 5,222,329 | 6/1993 | Yu | 451/5 |
| 5,308,438 | 5/1994 | Cote et al. | 451/41 |
| 5,514,245 | 5/1996 | Doan et al. | 156/636.1 |
| 5,527,424 | 6/1996 | Mullins | 156/636 |

OTHER PUBLICATIONS

Rodel, Inc. Polishing Pad Sales Literature 1994, Booklet (4 pgs.).

*Primary Examiner*—Robert A. Rose
*Assistant Examiner*—George Nguyen
*Attorney, Agent, or Firm*—George R. Meyer

[57] ABSTRACT

A polishing pad (34) with a poromeric structure polishes two dissimilar materials (56, 58). By using a relatively softer pad. and conditioning, relatively constant times can be used for polishing the dissimilar materials (56, 58). This makes polishing more predictable and increases the number of substrates that can be polished using a single polishing pad (34). Polishing pads (34) are typically changed when other maintenance is performed on the polisher rather than when the polishing rate becomes too low.

28 Claims, 4 Drawing Sheets

-PRIOR ART-

-PRIOR ART-

PROCESS FOR POLISHING A SEMICONDUCTOR DEVICE SUBSTRATE

FIELD OF THE INVENTION

The present invention relates generally to processes for polishing, and more particularly, to processes for polishing semiconductor device substrates.

BACKGROUND OF THE INVENTION

Chemical mechanical polishing (CMP) is presently used to polish a variety of materials found in semiconductor devices. Those materials include metals, such as tungsten, aluminum, and copper. Regardless of the type of material being polished, similar techniques are used. For example, a polishing system typically includes a polishing platen, on which is attached a polishing pad. While the platen is being rotated, a slurry is dispensed while a semiconductor wafer is pressed against the pad. A combination of the chemical reaction between the slurry and the layer being polished and the mechanical interaction between abrasives within the slurry and the layer being polished cause the planarization of the layer.

One factor that affects the characteristics of a polishing process is the type of polishing pad used. FIG. 1 illustrates a pad 10 containing a plurality of fibers 12 interspersed within a polyurethane matrix. In commercially available pads, fibers 12 include polyester or cellulose. One such commercially available polishing pad is the Suba 500 pad sold by Rodel, Inc. of Wilmington, Del., which has polyester fibers. FIG. 2 illustrates a polishing pad 14 that includes a plurality of polymer particles 16 and a plurality of voids 17. Voids 17 are created in polyurethane matrix 18 as a result of a heating process. A commercially available polishing pad having a structure similar to that illustrated in FIG. 2 is the IC-1000 pad also manufactured and sold by Rodel, Inc.

Polishing pads, such as those illustrated in FIGS. 1 and 2, do not provide ideal conditions for polishing two dissimilar materials during the same polishing operation. For example, when polishing a conductive layer that overlies an oxide layer, the conductive material is likely to be removed faster around the perimeter of the wafer compared to the center. Consequently, the polishing pad is exposed to an oxide layer and a conductive layer simultaneously. One problem is that a phenomenon known as glazing occurs and causes the pad surface to become smooth. To combat the problem of glazing, conditioning is performed using a diamond disk, for example. Conditioning is a process whereby the polishing pad is restored to close to its original porosity and texture by grinding away a very thin layer off the surface of the polishing pad. A diamond disk is used to accomplish this removal due to its hardness.

The hard conditioning disks impose a problem, particularly used in conjunction with polishing conductive materials. Commercially available diamond disks include diamond particles that are held in place on a disk by a plated metal, such as nickel. If conditioning occurs while a conductive layer is being polished, the slurry, which is used to remove the conductive layer, typically attacks the plating metal used to hold the diamonds on the conditioning disk. Consequently, over time the diamond particles on the disk loosen and contaminate the slurry and can lead to scratches and high particle counts on a wafer, among other problems.

Apart from the problems of polishing conductive and non-conductive (oxide) materials during a same polishing step, there are also problems in polishing two different conductive materials in the same step. For example, when polishing tungsten that is deposited on a titanium/titanium nitride layer, the polishing properties of tungsten and the titanium materials differ greatly. Titanium and titanium nitride are relatively difficult materials to polish using a process optimized for tungsten polishing. Slurry formulations that successfully polish titanium and titanium nitride do not polish tungsten as fast as other slurries. Yet, these other slurries are inefficient in removing the titanium or titanium nitride. In most cases, optimizing the polishing conditions for one material, for example tungsten, leads to a degradation of the polishing characteristics of the other materials, such as titanium or titanium nitride.

According, there is a need in the industry to establish a polishing process that effectively can polish two dissimilar materials in a cost effective manner that is conducive to a manufacturing environment.

BRIEF DESCRIPTION OF THE DRAWINGS

The present invention is illustrated by way of example and not limitation in the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures are exaggerated relative to other elements to help to improve understanding of embodiment(s) of the present invention.

DETAILED DESCRIPTION

A process for polishing a semiconductor device substrate includes two dissimilar materials, both to be polished in a same polishing step. In one embodiment, a tungsten layer is being polished together with an underlying titanium or titanium nitride layer. To polish these layers, the semiconductor device substrate is placed onto a polishing pad. The polishing pad includes a polymer based pad having a porm-eric structure formed on a backing layer, much like what is currently used in the industry as a finishing or buff pad. A polishing slurry including ferric nitrate ($Fe(NO_3)_3$) and alumina particles is used to remove the tungsten layer. The same pad and slurry are used to remove the underlying titanium or titanium nitride layer.

Because titanium and titanium nitride are typically more difficult to remove, use of a finishing or buff pad to remove the material may not be sufficient alone. Therefore, in one embodiment, the finishing or buff pad is conditioned to establish or maintain a sufficiently porous surface to get adequate polishing. Conditioning of the pad occurs before, during, or after polishing of the semiconductor device substrate. As used herein, a semiconductor device substrate includes any substrate used to form semiconductor devices, such as a monocrystalline semiconductor wafer, a semiconductor-on-insulator wafer, and the like.

Figure 3:
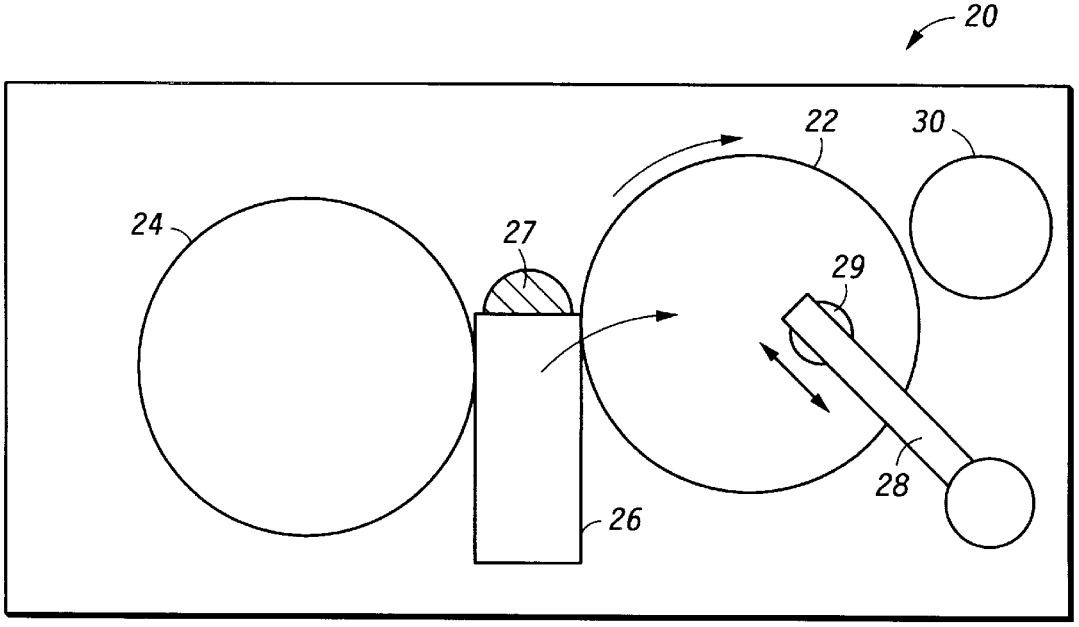
FIG. 3 includes an illustration of a top view of polisher used in accordance with one embodiment of the present invention.

FIG. 3 illustrates a polisher 20 including a polishing platen 22 and a finishing platen 24. A polishing arm 26 holds a semiconductor device substrate 27 that includes a layer to be polished and moves the substrate 27 over polishing platen 22. The substrate 27 is then pressed against the polishing platen 22 while the platen is being rotated to begin polishing. Polishing platen 22 includes a polishing pad (not shown in FIG. 3, see FIG. 4). During polishing of substrate 27, a conditioning arm 28 of the polisher presses a conditioning disc 29 against the polishing pad on the polishing platen 22. Conditioning disc 29 oscillates along the conditioning arm 28 from the center to edge of platen 22. Conditioning disc 29 helps to restore the polishing pad surface to an adequately porous state. Polishing continues until the desired amount of the layer being polished is removed from the substrate 27.

After material removal, polishing arm 26 moves the substrate 27 onto the finishing platen 24. The finishing platen 24 is also a rotating platen and includes a finishing pad or buff pad that is much softer than pads that are typically used in conventional polishing. The purpose of using a softer pad on finishing platen 24 has traditionally been to smooth the exposed surface of the semiconductor device substrate 27 and to removing residual abrasive particles that lie near the surface of the substrate 27.

Figure 4:
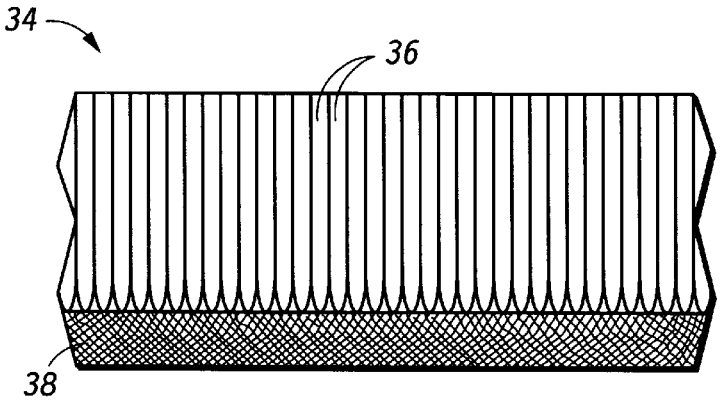
FIG. 4 includes an illustration of a cross-sectional view of polishing pad used in accordance with the present invention.

In accordance with the present invention, the polishing pad used on polishing platen 22 is more similar to a conventional finishing pad or buff pad. In one embodiment, the same type of pad is used on both platens 22 and 24. FIG. 4 includes an illustration of a cross-sectional view of a polishing pad 34 used in accordance with the present invention. The structure of the pad 34 is more similar to the structures that are typically used for finishing pads or buff pads as compared to the conventional polishing pads illustrated in FIGS. 1 and 2.

Polishing pad 34 of FIG. 4 includes a plurality of vertically oriented, elongated pores 36 that are orderly arranged on a polymer backing layer 38. Adjacent pores 36 share a common cell wall, much like a honeycomb structure. However, the pores need not be hexagonally shaped when viewed from the top of the pad. The pore structure illustrated in FIG. 4 is sometimes referred to as a poromeric polymer structure. In contrast, prior art polishing pads used to remove layers from a semiconductor device substrate, such as those illustrated in FIGS. 1 and 2, include randomly distributed pores, fibers, or fillers without an orderly and vertical orientation.

Figure 1:
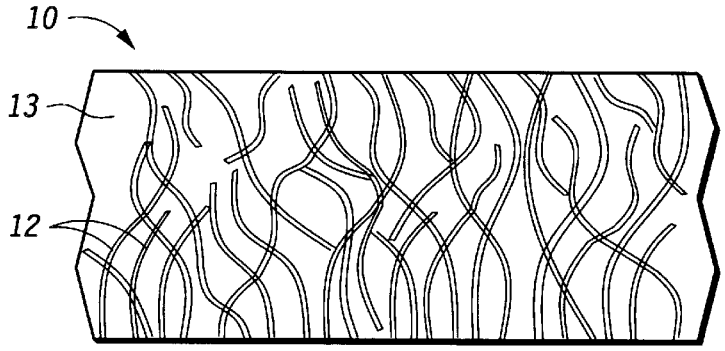
FIG. 1 includes an illustration of a cross-sectional view of a prior art polishing pad.
Figure 2:
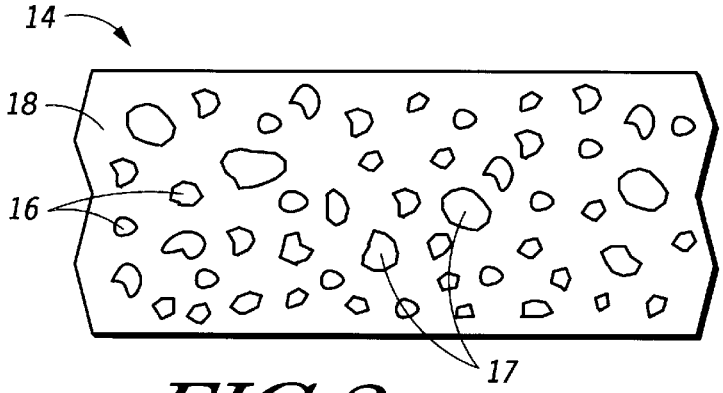
FIG. 2 includes an illustration of a cross-sectional view of another prior art polishing pad.

Another difference between the polishing pad 34, as used in accordance with the present invention, and conventional polishing pads, is the hardness of the two types of pads. For a polishing pad, the layer of the polishing pad that contacts a semiconductor device substrate during polishing is can be characterised by hardness. Referring to pad 34, the layer having pores 36, not the backing layer 38, is measured for hardness A pad used for polishing in accordance with the present invention has a Shore D hardness of less than approximately 45, and usually less than approximately 35. The Shore D hardness of pads, such as those depicted by FIGS. 1 and 2, are typically in excess of 50 and are usually closer to 60.

In one embodiment, the polishing pad 34 used to polish the substrate 27 is a Politex pad manufactured and sold by Rodel, Inc. of Wilmington, Del. Other suitable pads include Rodel's UR 100, 750, and 205 pads. Comparable pads from other pad manufacturers could also be used.

As mentioned above, polishing pad 34 is softer than conventional polishing pads used for polishing. A conditioner is used to condition the pad before, during or after polishing of the substrate. Certain traditional means for conditioning pads should not be used in practicing the invention because a finer and softer polishing pad is being used. For example, diamond discs, which are used to condition or deglaze conventional polishing pads, such as those depicted in FIGS. 1 and 2, should not be used to condition polishing pad 34. If a diamond disc was used, the poromeric structure of polishing pad 34 would be shredded or otherwise severely damaged by the diamond particles on the disc.

Figure 5:
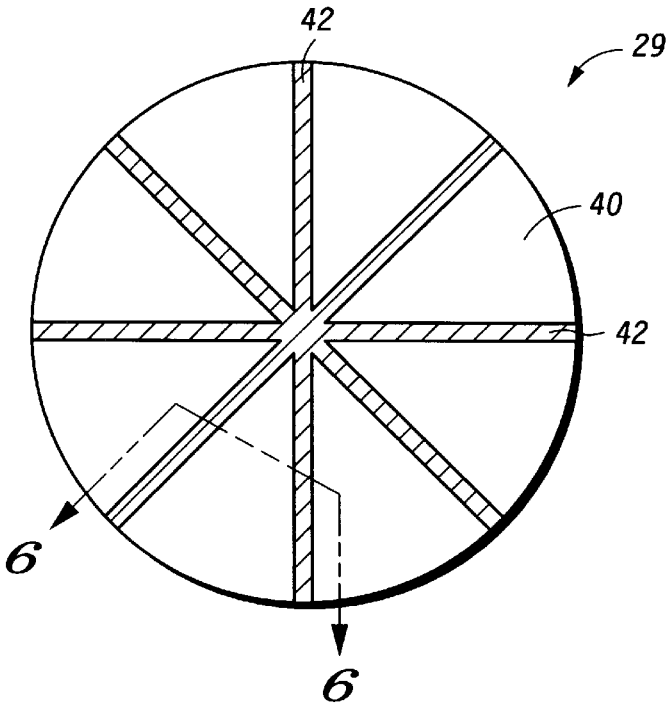
FIG. 5 includes an illustration of a view from the bottom of a conditioning disc used in accordance with one embodiment of the present invention.
Figure 6:
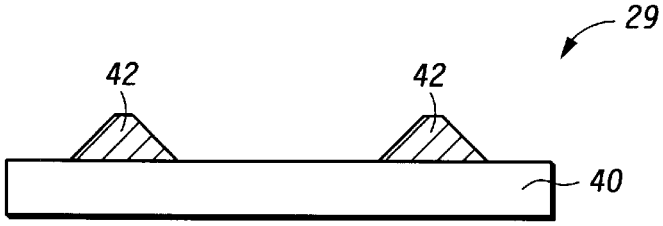
FIG. 6 includes an illustration of a cross-sectional view of the conditioning disc of FIG. 5.

Therefore, in accordance with the present invention, a different type of conditioner is used. Such a conditioner is a conditioning disc 29 as shown in FIG. 5 that includes a bottom view of the disc 29. In other words, the view of FIG. 5 illustrates the surface of the conditioning disc 29 that is pressed against the polishing pad 34 on the polishing platen 22 during conditioning. As illustrated, conditioning disc 29 has a disc base 40 and a plurality of ridges 42 as seen in FIG. 6. Ridges 42 protrude from disc base 40 and contact the polishing pad 34 during conditioning. In one embodiment, base 40 and ridges 42 are made of a fluorocarbon (polytrifluorochloroethylene, polytetrafluoroethylene, fluorinated ethylene-propylene, polyvinylidene fluoride (PVDF), etc.), polypropylene, polyethylene, polyvinyl chloride, and polyimide or a similarly smooth, chemically resistant material that can be easily machined to achieve the desired ridge configuration. In one particular embodiment, the conditioning disc 29 is made of PVDF because it is relatively less expensive and has most of the desired properties.

A ridge configuration such as that illustrated in FIG. 5 need not be used in practicing the present invention. Furthermore, it is not necessary that the conditioning element be a round disc. For example, a squeegee (blade) or a brush could be used to condition the polishing pad 34 without damaging the pad. When using disc 29, the disc should be oscillated between the center and edge of the platen 22 to provide uniform conditioning over those portions of the polishing pad 34 that polish substrate 27.

FIGS. 7–10 include illustrations of cross-sectional views of a semiconductor device substrate 50 that is polished in accordance with one embodiment of the present invention. The semiconductor device substrate 50 typically includes circuitry, such as transistors, diodes, capacitors, and the like, but are not shown in FIGS. 7–10. As mentioned previously, the present invention is particularly useful for polishing dissimilar materials in a single polishing operation. The embodiment described and illustrated in FIGS. 7–10 demonstrates the usefulness of practicing the present invention in polishing a tungsten layer that overlies a titanium/titanium nitride layer, such as might be used in forming conductive plugs. However, it is important to realize that the present invention is not limited to the polishing of these particular materials or only to forming conductive plugs.

Figure 7:
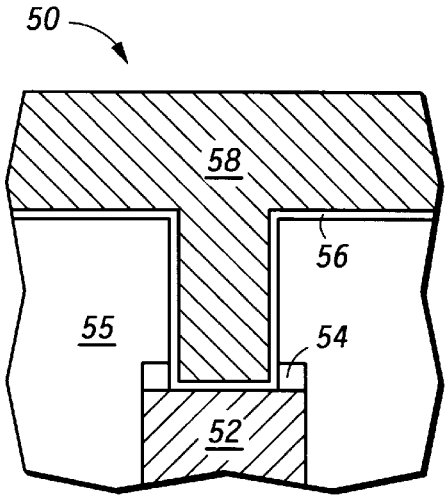
FIGS. 7–10 include illustrations of cross-sectional views of a semiconductor device being polished in accordance with one embodiment of the present invention.

Semiconductor device substrate 50 of FIG. 7 includes a metal interconnect 52 having an overlying antireflective coating (ARC) 54. Metal interconnect 52 includes aluminum, an aluminum alloy with copper or silicon, copper, or the like. ARC 54 is typically a metal nitride including titanium nitride, tantalum nitride, aluminum nitride, or the like.

An interlevel dielectric (ILD) layer 55 is deposited over metal interconnect 52 and ARC 54 and is etched to form a via opening which exposes a top portion of the metal interconnect 52. ILD layer 55 includes an oxide material that is chemically deposited and may be doped or undoped. The via opening is etched using conventional anisotropic dry oxide etching techniques.

After forming a via opening, the plug layer is formed by sequentially depositing an adhesion/barrier film and a plug filling film over the upper surface of the ILD layer and within the via opening. In one embodiment, titanium film deposited over the ILD layer 55 and partially reacted with ammonia to form titanium nitride to form the adhesion/barrier film 56.

After forming the adhesion/barrier film 56, the plug filling film 58 is deposited. In one embodiment, this material includes tungsten. Both the plug filling film 58 and the adhesion/barrier film 56 outside the opening is to be removed. The plug filling film 58 and adhesion/barrier film 56 include dissimilar materials.

Figure 8:
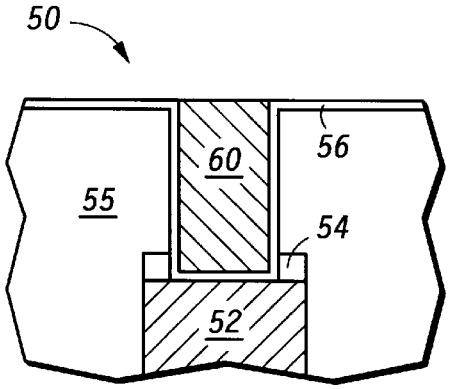
Figure 9:
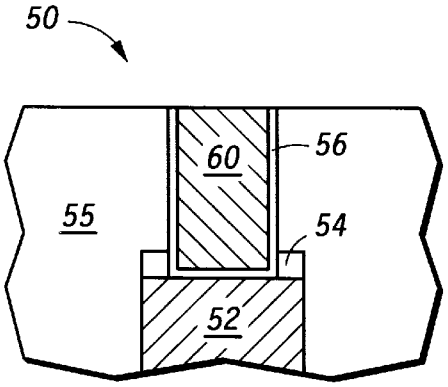

FIG. 8 illustrates semiconductor device substrate 50 after the plug filling film 58 has been substantially removed from above adhesion/barrier film 56. The tungsten layer is removed using the polisher 20 and the polishing pad 34 previously described. In one embodiment, tungsten is removed using a Politex polish pad in conjunction with an acidic ferric nitrate ($Fe(NO_3)_3$ slurry. Upon reaching adhesion/barrier film 56, the polishing rate changes. However, the polishing slurry pad nonetheless removes adhesion/barrier film 56, as shown in FIG. 9 without changing the slurry or any of the polishing parameters. After removing plug filling film 58 and adhesion/barrier layer, a plug 60 is formed within the via opening of the ILD layer 55.

After the polishing is performed on the polishing platen 22 using the polishing pad 34, the substrate 50 is moved to the finishing platen 24 to remove residual particles from the surface of the substrate 50. In one embodiment, a short dielectric polish using a basic slurry may be performed on the finishing platen 24 to provide a smooth surface to the ILD layer 55. A water rinse follows to remove any remaining basic slurry. In another embodiment, only water (without the basic slurry) is introduced over the finishing platen 24. The finishing platen 24 has a pad that is identical to the polishing pad 34. Alternatively, no finishing step on the finishing platen 24 is performed.

Figure 10:
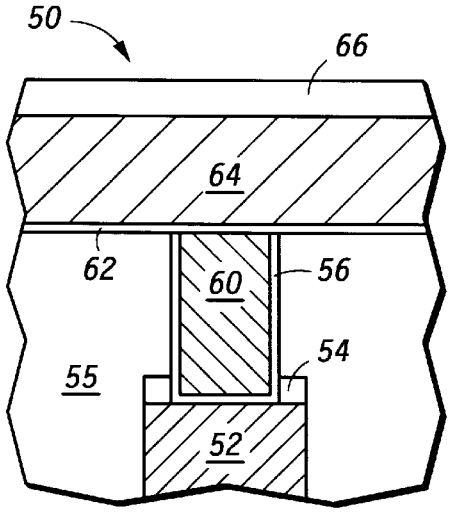

After plug formation is completed, the substantially completed semiconductor device 50 is formed as shown in FIG. 10. Another adhesion/barrier layer 62 similar to adhesion/barrier film 56 is deposited, and a second level of metalization, such as metalization 64 is deposited. Metalization 64 is similar to metal interconnect 52. If the second level of metalization is the uppermost level of metalization form interconnect within the device, a passivation layer 66 is then deposited. The passivation layer 66 includes a doped oxide, nitride, silicon oxynitride or the like.

In other embodiments, the ILD layer 55 can include other patterns, such as contact openings, and interconnect channels for a dual damascene process. In still other embodiments, the adhesion/barrier film 56 includes tantalum, tantalum nitride, molybdenum, molybdenum nitride, or the like. In another embodiment, interconnects within interconnect channels are formed by depositing an interconnecting layer and polishing. The interconnect layer includes an adhesion/barrier film and a metalization film. The adhesion/barrier film can include any material listed for adhesion/barrier film 56. The metalization film includes aluminum, an aluminum alloy with copper or silicon, copper, or the like. After depositing the films, the adhesion/barrier and metalization films are polished using polishing pad 34 in using a method similar to forming the conductive plug 60.

By using the polishing pad 34 and conditioning disc 29, the polishing rate of the adhesion/barrier film 56 and plug filling film 58 is optimized. Prior art attempts have focused on optimizing the plug filling film 58 polishing rate typically at the detriment of the adhesion/barrier film 56 polishing rate or optimizing the adhesion/barrier film 56 polishing rate typically at the detriment of the plug filling film 58 polishing rate. Also, in the prior art, the polishing rate of the adhesion/barrier film 56 and the plug filling film 58 decreases as more substrates are polished. A conventional polishing pad is changed about once every 200 substrates.

Figure 11:
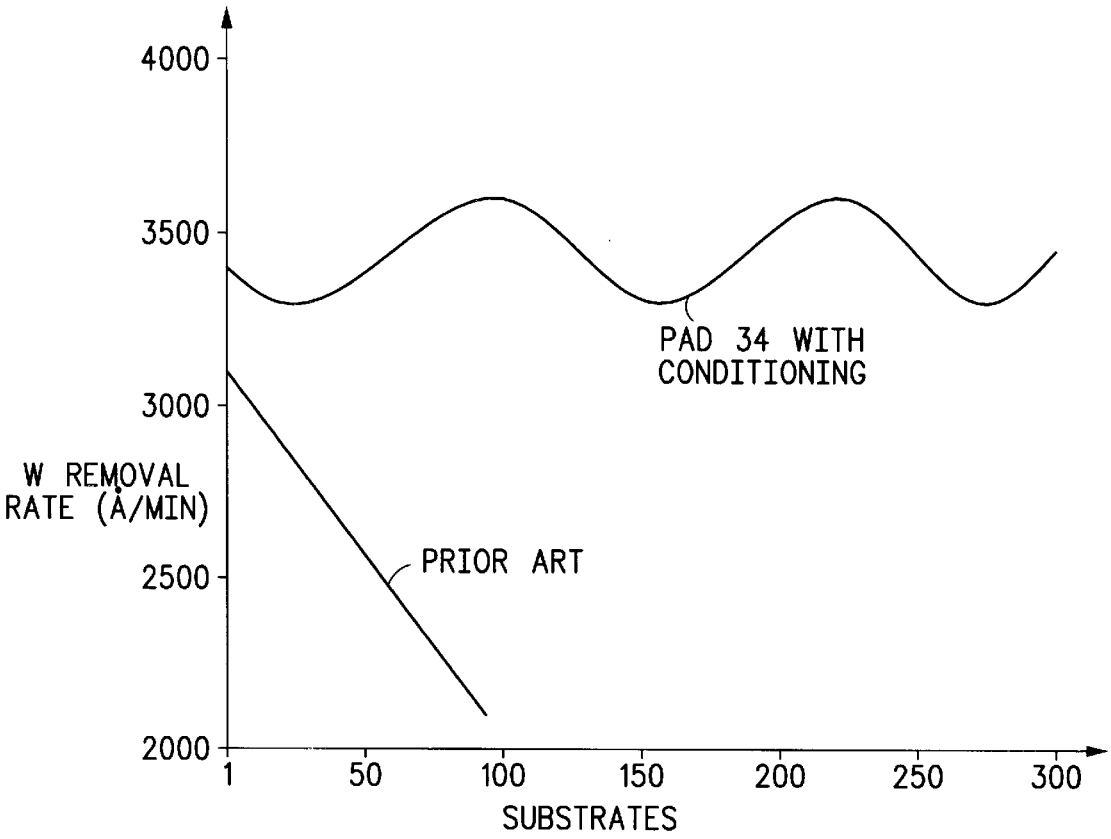
FIG. 11 includes a plot illustrating tungsten removal rate.

Unexpectedly, a reasonable polishing rate of the adhesion/barrier film 56 and the plug filling film 58 is achieved. The polishing rate of the plug filling film 58 remains relatively stable at about 3300–3700 angstroms per minute over about 700 wafers. FIG. 11 includes a plot of tungsten polishing rate comparing an embodiment of the present invention and a prior art method using a conventional polishing pad. When the tungsten removal rate is below 2500 angstroms per minute, the polishing pad needs to be changed. Note that the prior art has a tungsten polishing rate of about 2500 angstroms per minute after approximately 50 substrates. Equipment down time is reduced because the polishing pad 34 can be used for more substrates.

Figure 12:
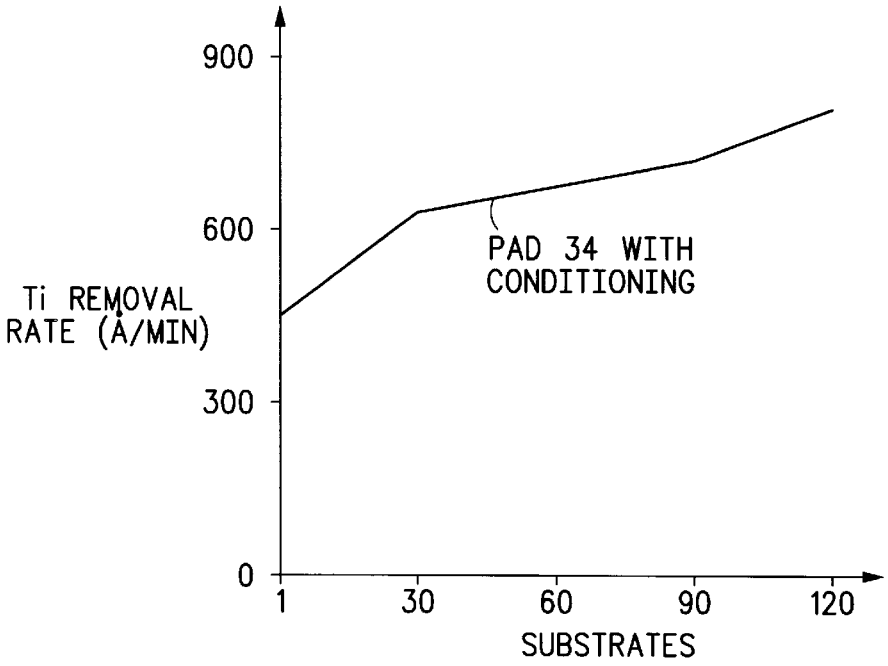
FIG. 12 includes a plot illustrating titanium removal rate.

The polishing rate of the adhesion/barrier film 56 increases, rather than decreases, as the number of substrates are polished as seen in FIG. 12. For example, the average polishing rate of the adhesion/barrier film 56 for the first ten substrates is approximately 450 angstroms per minute, approximately 500 angstroms per minute for the second ten substrates, and eventually reaches approximately 1000 angstroms per minute.

No theoretical limit of substrates is known for polishing using a single polishing pad 34. Therefore, the polishing pad 34 is changed when other factors, such as routine preventive maintenance and not too low of a polishing rate, determines when the polishing pad 34 is changed. A polishing pad 34 should be capable of polishing at least approximately 500 substrates between polishing pad changes. Although no limit is known, a single polishing pad may be used to polish more than 1000 substrates.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. In the claims, means-plus-function clause(s), if any, cover the structures described herein that perform the recited function(s). The mean-plus-function clause(s) also cover structural equivalents and equivalent structures that perform the recited function(s).

We claim:

1. A process for polishing a semiconductor device substrate comprising the steps of:

providing a polisher including a first pad having a Shore D hardness less than 35;

providing the semiconductor device substrate that includes a first patterned layer having an upper surface and a second layer overlying the upper surface of the first patterned layer;

placing a semiconductor device substrate onto the first pad;

polishing the semiconductor device substrate using the first pad to remove all portions of the second layer overlying the upper surface of the first patterned layer; and conditioning the first pad.

2. The process of claim 1, wherein:

the second layer includes a first film and a second film overlying a first film; and the first film includes a first material and the second film includes a second material that is different from the first material.

3. The process of claim 2, wherein:

the first material is selected from a group consisting of titanium, tantalum, molybdenum, titanium nitride, tantalum nitride, and molybdenum nitride; and the second material is selected from a group consisting of tungsten, aluminum, and copper.

4. The process of claim 2, wherein the first patterned layer includes a feature selected from a group consisting of a contact opening, a via opening, and an interconnect channel, wherein the upper surface lies outside of the feature.

5. The process of claim 1, wherein the step of conditioning is performed using a conditioner that includes a material selected from a group consisting of a fluorocarbon, polypropylene, polyethylene, polyvinyl chloride, and polyimide.

6. The process of claim 5, wherein the conditioner has a characteristic selected from a group consisting of a blade, a brush, and ridges attached to a disk.

7. The process of claim 1, wherein the step of polishing is performed using an acidic slurry.

8. The process of claim 1, wherein the step of polishing is performed for at least approximately 500 semiconductor device substrates using the first pad.

9. The process of claim 1, further comprising a step of forming a passivation layer over the first patterned and second layers after the step of polishing.

10. The process of claim 1, further comprising a step of buffing the semiconductor device substrate after the step of polishing.

11. The process of claim 10, wherein the step of buffing uses a second pad that has substantially same properties as the first pad.

12. The process of claim 11, wherein the step of buffing comprising steps of:

introducing a slurry onto the second pad while the semiconductor device substrate is present; and introducing water onto the second pad while the semiconductor device substrate is present after the slurry is no longer introduced onto the second pad.

13. A process for polishing semiconductor device substrates comprising the steps of:

providing a polisher including a first pad, a first plurality of ten semiconductor device substrates, and a second plurality of ten semiconductor device substrates, wherein each of the semiconductor device substrates of the first and second plurality of semiconductor device substrates includes a first layer;

polishing the first plurality of semiconductor device substrates using the first pad, a slurry, and polishing parameters; and polishing the second plurality of semiconductor device substrates using the first pad, the slurry, and the polishing parameters, wherein:

the step of polishing the second plurality is performed after the step of polishing the first plurality;

for the first plurality of semiconductor device substrates, the first layer has a first average polishing rate; and for the second plurality of semiconductor device substrates, the first layer has a second average polishing rate that is faster than the first average polishing rate.

14. The process of claim 13, wherein the first pad has polymeric pore structure and a Shore D hardness less than 35.

15. The process of claim 13, wherein:

each of the semiconductor device substrates of the first and second plurality of semiconductor device substrates includes a second patterned layer having an upper surface;

the first layer overlies the upper surface of the second patterned layer; and the first layer has a first film that includes a first material selected from a group consisting titanium, tantalum, molybdenum, titanium nitride, tantalum nitride, and molybdenum nitride.

16. The process of claim 15, wherein:

each of the semiconductor device substrates of the first and second pluralities of the semiconductor device substrates further comprises a second film overlying the first film; and the second film includes a second material is selected from a group consisting of tungsten, aluminum, and copper.

17. The process of claim 15, wherein the second patterned layer includes a feature selected from a group consisting of a contact opening, a via opening, and an interconnect channel, wherein the upper surface lies outside of the feature.

18. The process of claim 13, further comprising a step of conditioning the first pad during a step selected from a group consisting of polishing the first plurality of semiconductor device substrates and polishing the second plurality of semiconductor device substrates.

19. The process of claim 18, wherein the step of conditioning is performed using a conditioner that includes a material selected from a group consisting of a fluorocarbon, polypropylene, polyethylene, polyvinyl chloride, and polyimide.

20. The process of claim 19, wherein the conditioner has a characteristic selected from a group consisting of a blade, a brush, and ridges attached to a disk.

21. The process of claim 13, wherein the step of polishing is performed using an acidic slurry.

22. The process of claim 13, wherein the step of polishing is performed for at least approximately 500 semiconductor device substrates using the first pad.

23. The process of claim 13, further comprising a step of buffing the semiconductor device substrate after the step of polishing.

24. The process of claim 23, wherein the step of buffing uses a second pad that has substantially same properties as the first pad.

25. The process of claim 23, wherein the step of buffing comprising steps of:

introducing a slurry onto a second pad while the semiconductor device substrate is present; and introducing water onto the second pad while the semiconductor device substrate is present after the slurry is no longer introduced onto the second pad.

26. The process of claim 13, further comprising a step of forming a passivation layer over the first layer after the step of polishing.

27. The process of claim 13, further comprising a step of conditioning the first pad between the step of polishing the first plurality of semiconductor device substrates and the step of polishing the second plurality of semiconductor device substrates.

28. The process of claim 27, wherein the step of conditioning is performed using a conditioner that includes a material selected from a group consisting of a fluorocarbon, polypropylene, polyethylene, polyvinyl chloride, and polyimide.

* * * * *